US006827435B2

(12) United States Patent
Domoto et al.

(10) Patent No.: US 6,827,435 B2
(45) Date of Patent: Dec. 7, 2004

(54) MOVING AIR JET IMAGE CONDITIONER FOR LIQUID INK

(75) Inventors: Gerald A. Domoto, Briarcliff Manor, NY (US); Elias Panides, Whitestone, NY (US); S. Warren Lohr, Sleepy Hollow, NY (US); Roger Leighton, Rochester, NY (US); Dawn Api, Rochester, NY (US); Narayan V. Deshpande, Penfield, NY (US); Andrew W. Hays, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 389 days.

(21) Appl. No.: 10/040,813

(22) Filed: Jan. 7, 2002

(65) Prior Publication Data

US 2004/0046850 A1 Mar. 11, 2004

(51) Int. Cl.[7] ..... B41J 2/01

(52) U.S. Cl. ..... 347/102; 219/216; 101/424.1; 34/618; 34/620; 34/638; 34/658

(58) Field of Search ..... 34/618, 620, 638, 34/658, 60; 347/102; 219/216, 388, 400; 101/424.1

(56) References Cited

U.S. PATENT DOCUMENTS

| | | | | |
|---|---|---|---|---|
| 2,808,122 A | | 10/1957 | Meyers | 181/33 |
| 3,592,585 A | * | 7/1971 | Candor et al. | 8/151 |
| 4,340,893 A | | 7/1982 | Ort | 346/1.1 |
| 4,566,014 A | | 1/1986 | Paranjpe et al. | 346/1.1 |
| 4,970,528 A | | 11/1990 | Beaufort et al. | 346/25 |
| 5,140,377 A | | 8/1992 | Lewis et al. | 355/285 |
| 5,214,442 A | | 5/1993 | Roller | 346/1.1 |
| 5,349,905 A | | 9/1994 | Taylor et al. | 101/488 |
| 5,420,673 A | | 5/1995 | Itoh | 355/256 |
| 5,502,475 A | | 3/1996 | Kaburagi et al. | 347/102 |
| 5,631,685 A | | 5/1997 | Gooray et al. | 347/102 |
| 5,713,138 A | | 2/1998 | Rudd | 34/274 |
| 5,901,462 A | | 5/1999 | Rudd | 34/274 |
| 5,953,833 A | | 9/1999 | Rudd | 34/528 |
| 6,336,722 B1 | | 1/2002 | Wotton et al. | 347/102 |

* cited by examiner

*Primary Examiner*—Michael S. Brooke
(74) *Attorney, Agent, or Firm*—Perman & Green, LLP

(57) ABSTRACT

A dryer assembly for drying a liquid ink image formed on a substrate comprising a housing defining a portion of a sheet moving path; a plenum positioned within the housing, the plenum including air flow and outlet means contiguous to the plenum permitting forced air to exit the plenum, the outlet being in the form of a plurality of moving openings adapted to direct flowing air through the openings to the liquid image, the openings moving relative to the image; and a substrate transport device for moving the substrate carrying the liquid ink image on a front side thereof through the housing and under the plurality of moving openings. The dryer assembly has particular use in an ink jet printing system.

22 Claims, 3 Drawing Sheets

MOVING AIR JET IMAGE CONDITIONER FOR LIQUID INK

BACKGROUND OF THE INVENTION

1. Field of the Invention

This invention relates to systems and methods used for drying liquid ink images, and more particularly for a moving air jet for drying a liquid ink image in, such an apparatus as for example, a printer (e.g., as an ink jet printer or any black and white or color liquid ink printer), a facsimile machine that uses liquid ink development or an electrophotographic machine that employs liquid ink development (e.g. a xerographic copier).

2. Brief Description of Related Developments

In, for example, an ink jet apparatus the printing quality, such as, the uniformity of the ink density, the contrast of the ink with respect to the paper on which the ink is placed, or the lack of smearing, etc., is generally highly dependent upon the quality of the recording medium on which the ink is placed and also the surface tension of the ink. Inkjet printers that use a high surface tension recording medium, and therefore slow penetrating inks, including water soluble inks, require that care be taken to avoid smudging of the ink on the recording medium too soon after the ink is printed and to avoid offset problems, i.e., transfer of the ink onto an object that comes in contact with the recording medium, such as, for example, another piece of paper or a human hand. In general, it is desirable to be able to actively dry an inkjet printed image sufficiently so that the image bearing recording medium may be contacted by another object without there being smudging within 3 seconds after the image has been printed. Drying the printed ink is often accomplished naturally i.e., by ambient air drying, but active drying is also used, e.g., drying with a source of heat such as, for example, a radiant heater, a microwave heater, or a heated gas.

For example, U.S. Pat. No. 4,340,893 to Ort describes a scanning inkjet printer with an ink drying apparatus on the carriage where the drying apparatus includes a dryer body that directs unheated or heated air onto the printed ink, and even provides for re-circulation of the air. The humidity of the air may be monitored to obtain an indication of the drying capability of the system.

U.S. Pat. No. 4,970,528 to Beufort et al. discloses a uniform heat flux dryer system and method for an inkjet printer using an infrared bulb.

U.S. Pat. No. 5,349,905 to Taylor et al. teaches using a microwave dryer to dry a thermal inkjet printed image.

U.S. Pat. No. 5,502,475 to Kaburagi et al., teaches using an electrical resistance heater with a temperature control unit to dry an inkjet printed image.

U.S. Pat. No. 5,631,685 to Gooray et al. teaches using a microwave dryer for an inkjet printer. U.S. Pat. Nos. 5,713,138, 5,901,462 and 5,953,833 to Rudd teach the use of a dryer for wet coatings, including printing inks, the dryer using re-circulated, heated and pressurized air which impinges on the wet coated recording medium, and the use of energy emitters such as radiant heating elements.

U.S. Pat. No. 4,566,014 to Paranjpe et al. discloses a method of sheet feeding to enhance dryer operation, and discloses different types of dryers for ink drops on sheets, including a radio frequency dryer and a drying system employing dried and heated air blown at high velocity onto a sheet of paper to accelerate drying of the ink deposited on the sheet of paper.

U.S. Pat. No. 5,214,442 to Roller discloses an adaptive dryer which varies the feed rate of inkjet printed pages through a dryer and the temperature of the dryer, and also discloses a microwave dryer and a convective dryer.

U.S. Pat. No. 5,140,377 to Lewis et al. discloses a xerographic printing apparatus in which toner material is thermally fused and fixed onto a surface of a copy sheet by condensing water vapor on the surface of a copy sheet.

In commonly assigned and copending U.S. Ser. No. 09/721,736 filed Nov. 2, 2000 there is described a two-phase drying system and method for rapidly drying liquid ink that uses an active two-phase drying system. The invention separately provides for actively drying liquid ink using a brief water condensation interval to heat the liquid ink and recording medium, and following the water condensation interval, with a period of relatively low velocity laminar air flow, and following the laminar air flow, drying using a short period of modulated re-circulating hot air flow impinging on the wet ink. This results in the ink being dried in a rapid continuous manner equal to the printing rate so that no subsequent drying period is needed.

A general and basic requirement, in general, of liquid ink printers, particularly color printers, is that the previous image must be dried before a subsequent image can be written thereon. Drying can be achieved by using radiant energy to dry the fluid. However, this method is not preferred because of the long distance required for providing a heater in the process direction (requiring a long machine with a large footprint), and the possibility of fire or explosion due to the evaporating carrier fluid, especially if the carrier fluid or medium is flammable. Furthermore, the heated image-bearing medium may change its shape as the temperature thereof increases. This severely complicates, or makes impossible, the registration of the color separations.

Another drying method includes blowing room temperature air across the wet surface to vaporize the fluid. Due to the simplicity of this approach, this method is preferred in printers that operate at very low process speeds. However, very high flow rates or very high volumes of air will be required to dry images in high productivity applications, which makes this method somewhat impractical. Furthermore, this method may result in an image that is not uniformly dried across the process direction, leaving wet areas at the edges of the image.

With reference to FIG. 1, there is shown a schematic illustration of a conventional single pass color printer, generally indicated at 10, where a color image is created by superimposing color separations. The image processing involves passing a medium 11 over a writing head 12 to form a latent image for a first color 14. The medium 11 then passes over a development station 15 and a wet, visible image is created. The wet image is then moved past a drying station 16 which removes excess carrier fluid from the liquid image thereby preparing the image to receive the latent image for the next color 17. An example of this printer architecture is disclosed, for example, in U.S. Pat. No. 5,420,673. In such printers, room temperature air is blown across the wet image though a specifically designed channel to make more efficient use of the air. These dryers, although more effective than the dryers discussed above, present certain issues at high process speeds. The efficiency of these dryers is acceptable at high speeds only when the drying length is increased. Increasing the drying length however, results in a longer machine and larger footprint. Furthermore, sealing the air against a wide web is difficult and, as a consequence, this type of dryer becomes less efficient as air leaks past the medium.

One of the major issues that occur with many liquid ink drying techniques is the fact that after the drying process there are areas that are overdried and areas that are underdried. This is referred to as artifacts which show itself as image defects. The issue of artifacts arises frequently in high speed printing machines, e.g. a high speed ink-jet printer.

It is therefore a primary objective of the present invention to define a system and a technique (process) that can involve heating, cooling, drying, remoisturizing or any combination of these techniques, which avoids artifacts. The description which follows will focus on image drying where speed, safety and spatial uniformity are all required.

SUMMARY OF THE INVENTION

Quick and safe drying of wet images in accordance with the features of the present invention can be accomplished by the impingement of hot air flowing through many small jets (round nozzles) which move (i.e. are in motion) with respect to the image. This can be implemented by means of a suitable (i.e. considering both type of material and thickness) belt which has many holes in it, and whose movement (i.e. motion) can be independently adjusted. Air is supplied at a temperature that is sufficiently high to effect drying (approximately 200° C.), but low enough to avoid scorching after prolonged exposure (i.e. something that could occur if there is a jam of the machine). Continuous and rapid movement (i.e. motion) of the jets relative to the image, ensures image drying uniformity and the absence of artifacts. The relative speed of the movement is suitably adjusted in accordance with optimum operating conditions. "Hole speeds" can vary within a range dependent upon sheet speed. Hole speed might equal or be about 10 times faster than sheet speed. Hole velocity may be opposite of sheet velocity.

In accordance with the preferred features of the embodiments described herein, a dryer assembly for drying a liquid ink image formed on a substrate comprises a housing defining a portion of a sheet moving path; a plenum positioned within the housing, the plenum including air flow and outlet means contiguous to the plenum permitting forced air to exit the plenum. The outlet is in the form of a plurality of moving openings (i.e. opening in movement relative to the liquid ink image) that are adapted to direct flowing air through the openings while in movement to the liquid image. The openings thus move relative to the liquid ink image. A substrate transport device moves the substrate carrying the liquid ink image on a front side thereof through the housing and under the plurality of moving openings.

In accordance with another preferred feature of the embodiments described herein there is described an ink jet printing machine for printing a liquid ink image on a sheet of paper as it moves along a sheet path through a printing zone. The ink jet printing machine includes a frame; a printhead mounted to the frame and containing liquid ink for depositing an image onto the sheet of paper to form a liquid ink image thereon, a dryer assembly for drying the liquid ink image on the sheet of paper, the dryer assembly comprising (i) a housing defining a portion of the paper sheet moving path; (ii) a plenum positioned within the housing, the plenum including air flow and an outlet means permitting forced air to exit the plenum. The outlet is in the form of a plurality of moving openings (i.e. openings in movement relative to the liquid ink image) that are adapted to direct flowing air through the openings while in movement with regard to the liquid image. The openings thus move relative to the liquid ink image. A paper sheet transport device moves the paper carrying the liquid ink image on a front side thereof through the housing and under the plurality of moving openings. A controller is connected to a forced air feeding device for controllably blowing air onto the sheet, i.e. only when there is interrupted sheet movement through the housing of the sheet within the housing.

BRIEF DESCRIPTION OF THE DRAWINGS

The accompanying drawings, which are incorporated in and constitute a part of the specification, illustrate one embodiment of the invention and, together with the description, serve to explain the principles of the invention.

While the present invention will be described hereinafter in connection with the preferred embodiments thereof, it should be understood that it is not intended to limit the invention to these embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

Drying of wet ink images is a critical enabler for increasing productivity in liquid ink based machines e.g., especially in high speed ink printers. However, drying must be accomplished quickly, safely, efficiently, and without disturbing the image.

Jet impingement is known to be an efficient means for heat transfer, and is used in many applications which require quick heating (or cooling) of a surface. Laboratory tests have shown that jet impingement of hot air at 190° C. can be used to quickly and safely dry wet images. However, these same tests have also shown that noticeable image artifacts appear, which mirror the cross-sectional geometry of the jets. These artifacts are the result of one or more of the following effects; surface tension variations due to thermal gradients or static pressure gradients and shear stress gradients.

Figure 1:
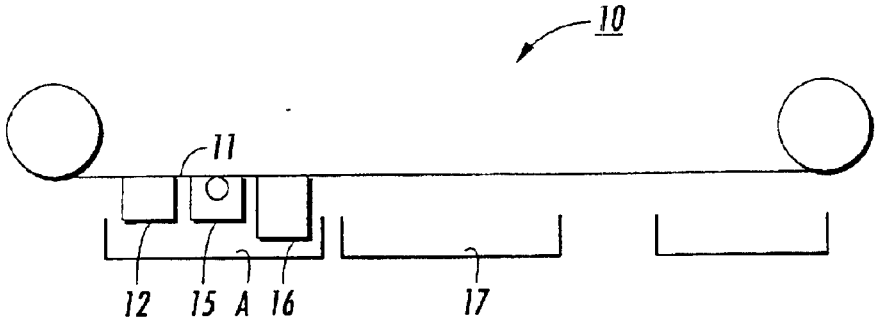
FIG. 1 PRIOR ART
FIG. 1 is a schematic illustration of a conventional single pass color printer having a drying assembly.
Figure 2:
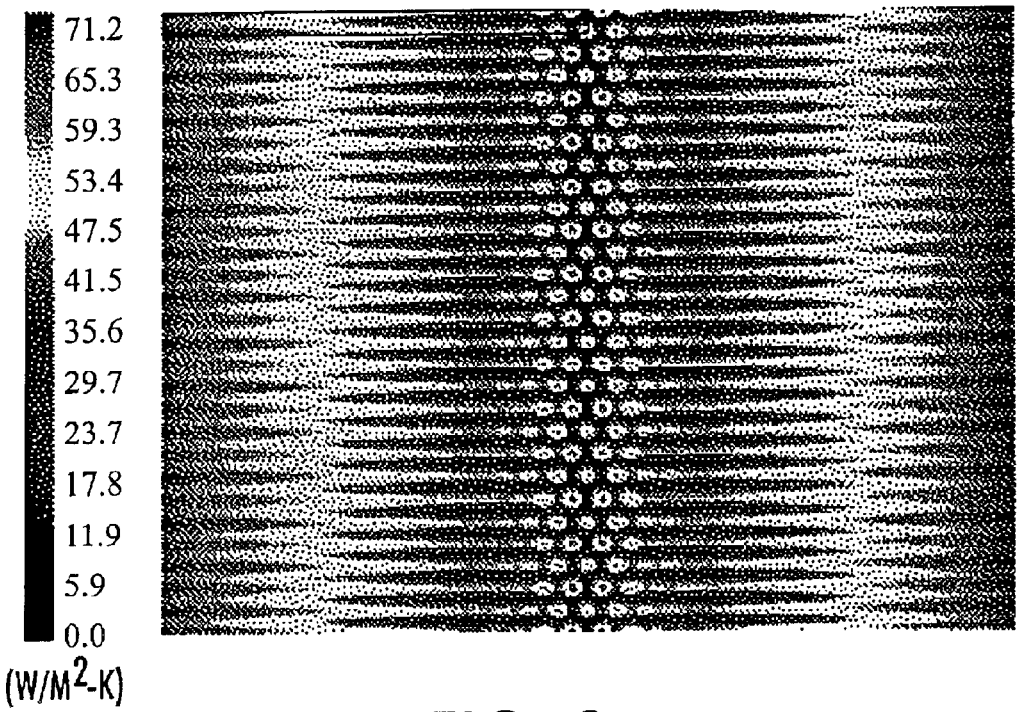
FIG. 2 is a computer simulation of the contours of a surface heat transfer coefficient ($W/M^2$–K)

Computer simulation (see FIG. 2) for the geometry and operating conditions used in the laboratory, was employed to understand and identify which of these effects is at work. Results of the surface heat transfer coefficient ($W/M^2K$ . . . watts/sq. meter per degree Kelvin) are shown in FIG. 2. Corresponding results for the static pressure and shear stress distributions do not show such dramatic spatial variations. Thus, it is concluded that thermal gradients are the underlying cause of image artifacts.

As further illustrated in FIG. 2 by the streak pattern on the left and right sides of the computer simulation, there is an uneven distribution of the drying pattern. As illustrated by the area of circles extending in the middle portion of the computer simulation, there is an area of very high over drying conditions.

Figure 3:
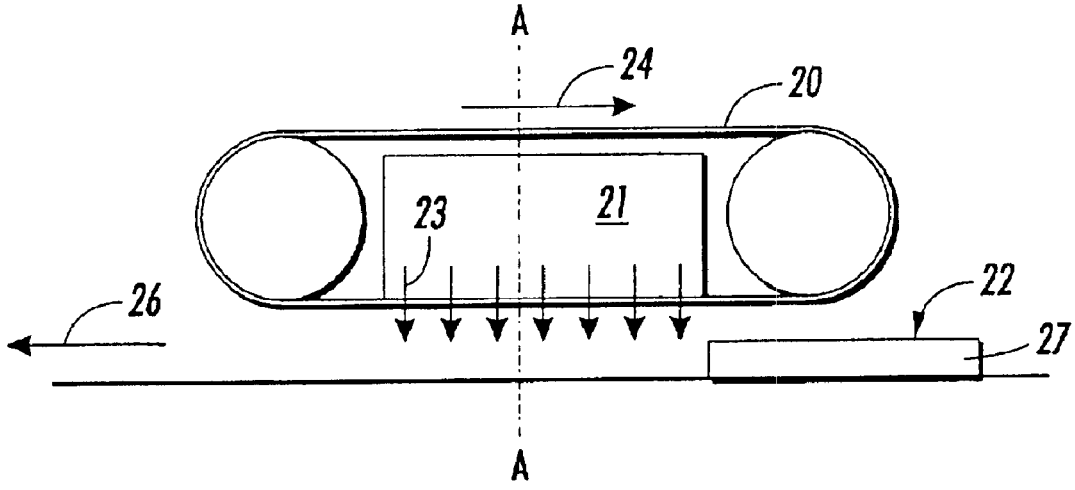
FIG. 3 is a schematic illustration of one embodiment for a drying assembly as described herein.

FIG. 3 illustrates a first embodiment of a dryer assembly 20 that incorporates the systems and methods for drying liquid ink according to the embodiments of the present invention. Artifacts, as described above, can be eliminated in accordance with the features of this invention by moving air jets used to blow drying air on the liquid ink image relative to the image. For rapidly moving jets and a random pattern along the line of motion, the drying which occurs on any given area of the image is the cumulative result of the contributions of a large number of jets uniformly distributed about the area. The faster the speed, the greater the number of contributing jets and the smaller the resulting wavelength of spatial variations. The speed can thus be suitably adjusted so that spatial variations become very small and imperceptible.

There are several embodiments by which the jet motion can be practically implemented.

For example, and as shown in FIG. 3, there is illustrated the use of a perforated belt 20 much like a vacuum corrugation feeder in reverse, in which a positive gauge pressure is maintained in the plenum 21 instead of a vacuum, the plenum being positioned within a housing (not shown). The perforated belt 20 employs relatively small diameter holes 25 or relatively narrow width slots, or both. Hole diameter is determined by Nusselt Number, which must be optimized for a round impinging jet with forced connective flow directed normally against a flat surface. An example of a hole diameter that can be used with the present invention are holes of about lm in diameter. The holes 25 (openings) which form the air jets can be arranged in various patterns, including square or staggered-row patterns or chevron row patterns or others. In one embodiment using jet holes 25, the spacing between holes is about four times the diameter of the holes 25. In an exemplary embodiment using openings 25 in the form of slots, the spacing between the slots 25 is about four times the slot width in the belt feed direction 24 and the length of each slot is about 100 times the slot width running in the direction across the feed direction of the belt 20. The total open area of the holes 25 and/or slots, and the delivered volumetric air flow rates are expected to provide an air impingement jet velocity of about 5.55 meters per second, i.e. about 18.2 feet per second. In some embodiments according to the invention, the holes 25 or slots 25 were provided with rounded edges to lower flow pressure loss and to provide a relatively wider air jet flow distribution profile.

The air plenum (21 or 30) is provided with thermal insulation to reduce loss of heat from the dryer assembly, to reduce the temperature of the outside surface of the dryer assembly in order to reduce the danger and possibility of personnel burns, and also to save power. The insulation is chosen to provide attenuation and damping of sound and noise generated by any recirculation air fan that is positioned in the dryer. Any recirculation air fan has a motor element which is typically mounted outside the dryer assembly while the drive shaft and blade assembly of the fan is typically located inside of the dryer assembly. To further reduce noise generated by the fan, the combined configuration volume of the air return together with hole or slot 25 size and pattern is designed to operate as a low pass sound filter tuned to the sound frequency as generated by the fan. Principles of using a resonant type sound cancellation structure to reduce noise are illustrated in U.S. Pat. No. 2,808,122 of inventor John J. Meyers the disclosure of which is incorporated herein by reference. In another illustrative embodiment, the electrical motor of the fan may be inside of the dryer plenum (21 or 30) to use its electrical power to help heat the air. However, this requires a motor design (materials and lubrication) which will tolerate the temperature in the dryer, which is typically 150° C. or higher. Commercial motors are available to operate at high temperatures but are relatively expensive. If cost is a factor, the motor can be placed outside of the dryer by employing a drive shaft extension. The edges of the plenum should preferably be tightly sealed to avoid leakage, and the belt 20 must be capable of withstanding relatively high temperatures (e.g. from about 50° C. to about 200° C.). The hole pattern must be sufficiently random along the direction of motion. This can be accomplished if a regular hole pattern 25 is slightly slanted with respect to the line of motion (as shown in FIG. 4).

As further shown in FIG. 3, the wet liquid ink image 22 is transported so as to be positioned within the range of the air jets 23 that are moving e.g. in the direction of arrow 24, i.e. the wet liquid ink image should be in contiguous relation to the blowing air jets 23. In accordance with the specific features of the present invention and the embodiments described herein, it is significant that the air jets 23 move relative to the wet image 22. Thus, it is within the scope of the present invention that the wet image 22 be transported to the air flow 23 under the moving openings 25 (i.e. move in the direction of arrow 24), and then brought to a stop under the moving air jets 23 to dry. In the alternative the wet image 22 can be moving in the direction of arrow 26 when brought in contact with air jets 23 and remain in contact with the blowing air while moving under moving air jets 23 for a time that is sufficient to dry the wet image. Whether (i) brought to a complete stop under the moving air jets or (ii) moving under the moving air jets, the critical feature in accordance with the embodiments described herein is that the air jets 23 are always moving relative to the wet image 22. Although the temperature of the air jets 23 can vary from cool to hot, it has been found that a blowing air temperature of from about 50° C. to about 200° C. is eminently suitable.

Figure 4:
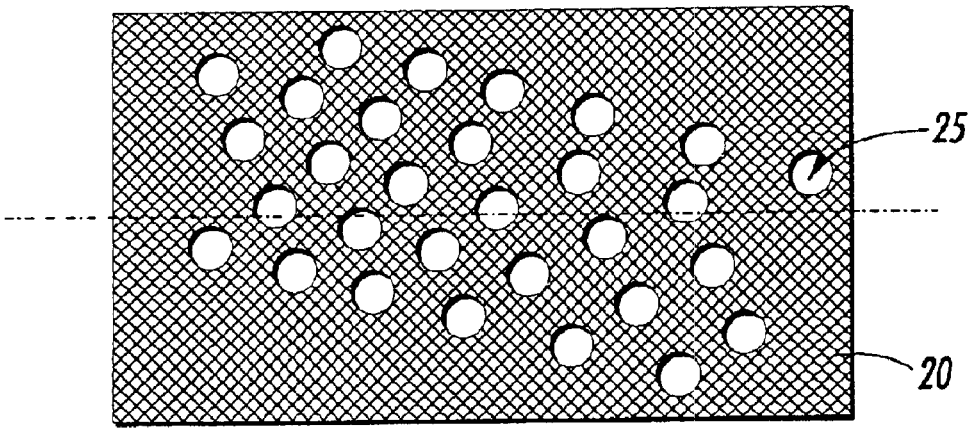
FIG. 4 is a top plan view of one embodiment of a belt with openings therein for use with a drying assembly as defined herein.

FIG. 4 is a top view in the form of another example of an embodiment of a belt 20 having a plurality of openings (holes) 25 arranged in a random pattern in accordance with the features of the present invention.

Figure 5:
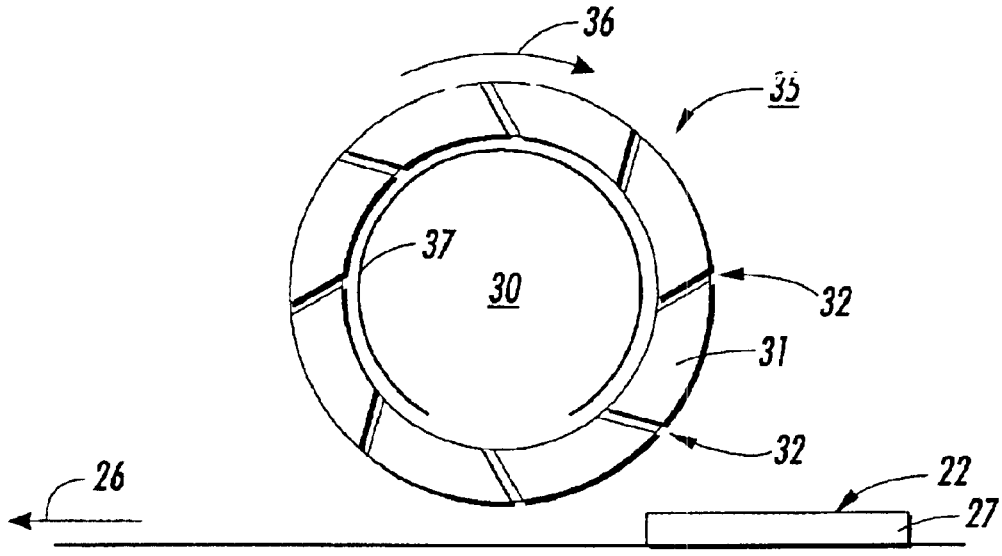
FIG. 5 is a schematic illustration of another embodiment for a drying assembly as described herein.

Still another embodiment in which one can effect air jet motion in accordance with the features described herein is shown in FIG. 5. Here, the plenum 30 is a cylindrical cavity whose wall includes slots 32 which run along the depth of the plenum 30. The cylinder 35 is rotated in the direction of arrow 36 such that the impinging flow of hot air from the slot jets 32 is rapidly swept across the image 22. A sheath 37 positioned inside the plenum 30 allows flow only through the jets, in close proximity to the wet image 22. As shown in FIG. 5, the slots 32 can be cut at an angle with respect to the radial direction such that the flow itself powers the rotary motion of the cylindrical plenum, similar to a water sprinkler.

Still another embodiment (not shown) to effect moving jets would be in the form of a perforated disc spinning on its axis, and ejecting flow normal to the sheet image. Once again, self motorized action is possible.

While this invention has been described in conjunction with the exemplary embodiments outlined above, it is evident that many alternatives, modifications and variations will be apparent to those of ordinary skill in the art. Accordingly, the exemplary embodiments of the invention, as set forth above, are intended to be illustrative, and not limiting. Various changes may be made without departing from the spirit and scope of the invention.

What is claimed is:

1. A dryer assembly for drying a liquid ink image formed on a substrate, the assembly comprising:

(a) a housing defining a portion of a sheet moving path;

(b) a plenum positioned within the housing, the plenum including air flow and outlet means contiguous to the plenum permitting forced air to exit the plenum, the outlet means being in the form of a plurality of openings that move relative to the housing and are adapted to direct flowing air through the openings to the liquid image, the openings moving relative to the image; and (c) a substrate transport device for moving the substrate carrying the liquid ink image through the housing and under the plurality of moving openings so as to quickly dry the liquid ink image.

2. A dryer assembly in accordance with claim 1 wherein said substrate is paper.

3. A dryer assembly in accordance with claim 1 wherein said assembly is a dryer in an ink-jet printing apparatus.

4. A dryer assembly in accordance with claim 1 wherein said assembly is a dryer in a facsimile machine.

5. A dryer assembly in accordance with claim 1 wherein said forced blowing air is heated air.

6. A dryer assembly in accordance with claim 5 wherein said forced blowing air is heated to a temperature sufficiently high to effect drying of said liquid ink but low enough so as not to cause scorching of said substrate after prolonged exposure to said forced heated air.

7. A dryer assembly in accordance with claim 6 wherein the temperature of said heated air is from about 50° C. to about 200° C.

8. A dryer assembly in accordance with a claim 1 wherein a moisture vapor is blown in with the forced air.

9. A dryer assembly in accordance with claim 1 wherein said moving openings are positioned within a moving perforated belt.

10. A dryer assembly in accordance with claim 9 wherein said belt rotates about said plenum.

11. A dryer assembly in accordance with claim 1 wherein said moving openings form a plurality of moving jets of air.

12. A dryer assembly in accordance with claim 9 wherein there is a random pattern of said openings in said belt along the line of motion for said belt.

13. A dryer assembly in accordance with claim 1 wherein a positive gauge pressure is maintained in said plenum.

14. A dryer assembly according to claim 1, wherein said plenum is a rotating cylindrical cavity having walls including slots formed therein, the slots adapted to form air jets whereby the air can flow from the slots to said wet image.

15. A dryer assembly according to claim 14 wherein said slots are formed at an angle to the radial direction of said cylinder whereby the flow of air through said slots powers the rotary motion of said cylindrical plenum.

16. A dryer assembly according to claim 14 wherein a sheath is positioned inside said cylindrical plenum, the sheath adapted to allow air flow only through those slots in close proximity to said wet image.

17. An ink jet printing machine for printing a liquid ink image on a sheet of paper moving along a sheet path through a printing zone therein, the ink jet printing machine, comprising:

(a) a frame;

(b) a printhead mounted on the frame and containing liquid ink for depositing a liquid ink image onto the sheet of paper;

(c) a dryer assembly for drying the liquid ink image on the sheet of paper, the dryer assembly including:

(i) a housing defining a portion of the paper sheet moving path;

(ii) a plenum positioned within the housing, the plenum including air flow and an outlet means permitting forced air to exit the plenum, the outlet being in the form of a plurality of openings that move relative to the housing and are adapted to direct flowing air to the liquid image, the openings moving relative to the image;

(iii) a paper sheet transport means for moving the paper carrying the liquid ink image through the housing and under the plurality of moving openings; and (d) a controller connected to a forced air feeding device for controllably blowing air onto the sheet only when there is sheet movement through the housing of the sheet.

18. An ink jet printing machine according to claim 17 wherein said moving openings are, located within a moving perforated belt, the belt rotating about said plenum.

19. An ink jet printing machine according to claim 17 wherein said plenum is a rotating cylindrical cavity having walls including slots formed therein, the slots adapted to form air jets whereby the air can flow from the slots to said wet image.

20. An ink jet printing machine according to claim 19 wherein said slots are formed at an angle to the radial direction of said cylinder whereby the flow of air through said slots powers the rotary motion of said cylindrical plenum.

21. An ink jet printing machine according to claim 20 wherein a sheath is positioned inside said cylindrical plenum, the sheath adapted to allow air flow only through those slots in close proximity to said wet image.

22. An inkjet printing machine according to claim 17 wherein said paper sheet transport means includes a controller adapted to move said paper carrying the liquid ink image in contiguous relation to said plurality of moving openings and to stop the image to allow said liquid ink image to dry.

* * * * *